US005136992A

United States Patent [19]

Bregler et al.

[11] Patent Number: 5,136,992

[45] Date of Patent: Aug. 11, 1992

[54] PISTON FOR INTERNAL COMBUSTION ENGINES WITH FORGED SECTIONS MADE OF STEEL

[75] Inventors: Werner H. Bregler, Schorndorf; Dieter Muller-Schwelling, Fellbach-Offingen, both of Fed. Rep. of Germany

[73] Assignee: Mahle GmbH, Stuttgart, Fed. Rep. of Germany

[21] Appl. No.: 728,255

[22] Filed: Jul. 11, 1991

[30] Foreign Application Priority Data

Jul. 12, 1990 [DE] Fed. Rep. of Germany ..... 4022289
Aug. 1, 1990 [DE] Fed. Rep. of Germany ..... 4024381

[51] Int. Cl.[5] ..... F02F 3/00; C22C 38/00; C22C 38/24

[52] U.S. Cl. ..... 123/193.6; 148/328; 92/222

[58] Field of Search ..... 123/193.6; 148/328; 420/101, 127, 87, 32, 33; 75/236, 237; 92/222

[56] References Cited

U.S. PATENT DOCUMENTS

| | | | |
|---|---|---|---|
| 2,914,401 | 11/1959 | Payson | 148/328 |
| 3,558,370 | 1/1971 | Bomi | 148/328 |
| 4,160,066 | 7/1979 | Szumachowski et al. | 148/328 |
| 4,318,733 | 3/1982 | Ray et al. | 420/101 |
| 4,838,963 | 6/1989 | Huchtemann et al. | 148/328 |
| 5,013,524 | 5/1991 | Leban | 148/328 |
| 5,023,049 | 6/1991 | Norstrom et al. | 148/328 |

*Primary Examiner*—E. Rollins Cross
*Assistant Examiner*—M. Macy
*Attorney, Agent, or Firm*—Collard & Roe

[57] ABSTRACT

In an internal combustion engine, a piston has forged sections made of steel, especially in the piston head area, as well as at the hubs, and areas made of light metal, especially in the area of the piston skirt. The previously used quenched and drawn steel 42CrMo4V is to be replaced with a steel that has comparable properties but is more cost effective to manufacture. This replacement steel is a precipitation hardened ferrite-perlite steel.

2 Claims, 1 Drawing Sheet

PISTON FOR INTERNAL COMBUSTION ENGINES WITH FORGED SECTIONS MADE OF STEEL

BACKGROUND OF THE INVENTION

1. Field of the Invention

The present invention relates to a piston for internal combustion engines with forged sections made of steel.

2. The Prior Art

In the past, quenched and drawn chromium-molybdenum steel, for example, 42CrMo4 was predominantly used as the steel from which pistons were manufactured. This steel was considered to be a very good compromise for this type of use, with regard to its formability, its strength characteristics, process ability, hardenability and costs.

SUMMARY OF THE INVENTION

It is an object of the present invention to provide a more cost-effective material, especially one that can be more cost-effectively processed, with comparably good proper-ties.

This object is accomplished, according to the present invention, by the use of a known steel which is selected from the group of precipitation hardened ferrite-perlite steels with the alloy element ingredients being present in weight percent as follows:

C=0.32–0.45
Si=0.4–0.9
Mn=1.0–1.8
P=up to 0.035
S=up to 0.065; and
V=0.06–0.15.

The balance of the alloy up to 100 percent by weight is iron. Such steels are known from *Dubbel Taschenbuch fur den Maschinenbau* (*Dubbel Pocket Book for the Construction of Machinery*), 1990 Edition, pp. E36–E37.

More particularly, the above objects are accomplished according to the present invention by an articulated piston for use in an internal combustion engine having a forged crown with hubs as an integrated head section made of steel and a skirt joined to each other only by a piston pin; and wherein the steel is a precipitation hardened ferrite-perlite steel.

BRIEF DESCRIPTION OF THE DRAWINGS

Other objects and features of the present invention will become apparent from the following detailed description considered in connection with the accompanying drawing which discloses one embodiment of the present invention. It should be understood, however, that the drawing is designed for the purpose of illustration only, and not as a definition of the limits of the invention.

In the drawing wherein similar reference characters denote similar elements throughout the several views.

DETAILED DESCRIPTION OF PREFERRED EMBODIMENT

The use of a specific steel composition in the piston according to the present invention, has proven to be particularly advantageous. The metal alloy element components in this specific steel composition are indicated as being present in the following percent by weight as follows:

C=0.35–0.40;
Si=0.5–0.8;
Mn=1.2–1.5;
P=up to 0.035;
S=0.03–0.065;
V=0.08–0.13; and the balance of the alloy up to 100 percent by weight of Fe.

Figure 1:
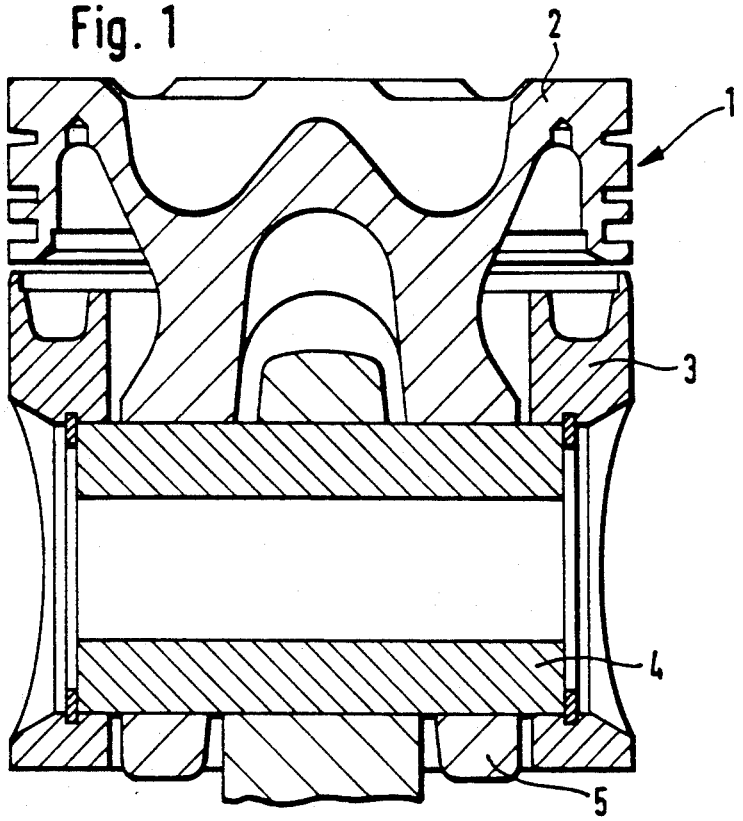
FIG. 1. is a longitudinal cross-sectional view of an articulated piston with a head and skirt part joined to each other by a piston pin.
Figure 2:
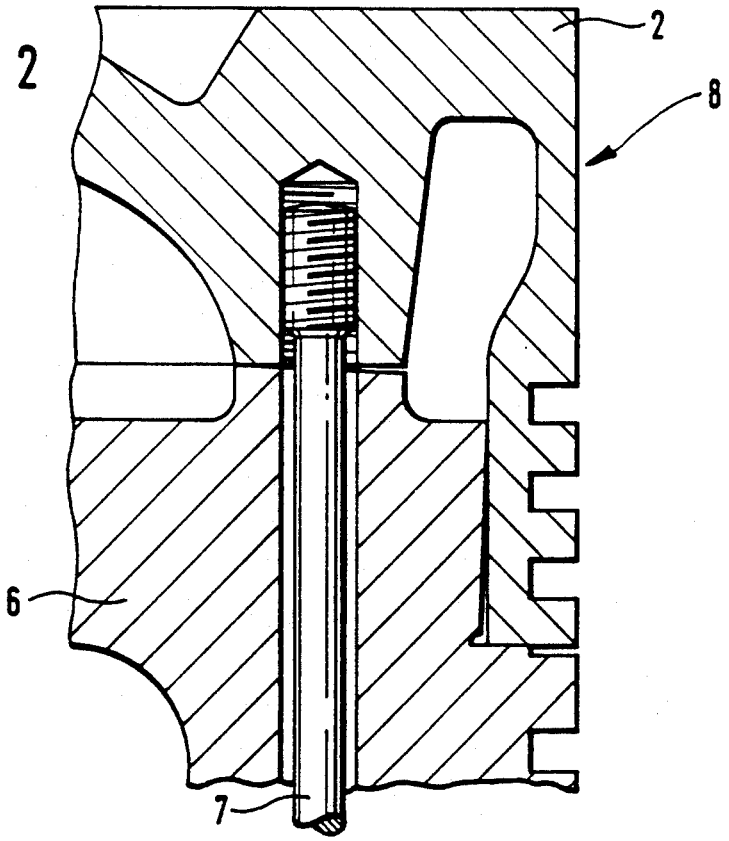
FIG. 2 is a section of a longitudinal cross-sectional view of a piston with a head as an upper piston part joined to a bottom piston part by screws.

Turning now in detail to the drawings, in FIG. 1, the steels proposed according to the invention are particularly suitable for use for an articulated piston 1, in which the piston head 2 is connected with the skirt 3 only by means of the piston pin 4, at the hubs 5 of the piston head 1.

The piston skirt 3 can be made of a light metal such as aluminum or magnesium.

Another area of use is for pistons 8 in which the piston head 2 is made of steel and is rigidly connected with the bottom part 6 of the piston by means of screws 7. The bottom part 6 can be made of a light metal such a aluminum.

While only a single embodiment of the present invention has been shown and described, it is to be understood that many changes and modifications may be made thereunto without departing from the spirit and scope of the invention as defined by the appended claims.

What is claimed is:

1. A piston for use in an internal combustion engine with at least a forged piston head made of steel;

wherein the steel is a precipitation hardened ferrite-perlite steel alloy; and wherein said steel alloy has the following composition with each alloy element indicated as a weight percent:

C=0.32–0.45
Si=0.4–0.9
Mn=1.0–1.8
P=up to 0.035
S=up to 0.065
V=0.06–0.15; and the balance of the alloy up to 100 percent by weight of Fe.

2. The piston according to Claim 1, wherein said steel alloy has the following composition with each alloy element indicated as a weight percent:

C=0.35–0.40
Si=0.5–0.8
Mn=1.2–1.5
P=up to 0.035
S=0.03–0.065
V=0.08–0.13; and the balance of the alloy up to 100 percent by weight of Fe.

* * * * *